US005415710A

United States Patent [19]

Shiina et al.

[11] Patent Number: 5,415,710

[45] Date of Patent: May 16, 1995

[54] HEAT-RESISTANT ALUMINUM ALLOY HAVING HIGH FATIGUE STRENGTH

[75] Inventors: Haruo Shiina; Fumito Usuzaka, both of Asaka; Yoshimasa Ohkubo; Shinichi Tani, both of Nagoya, all of Japan

[73] Assignees: Honda Motor Co., Ltd.; Sumitomo Light Metal Industries, Ltd., both of Tokyo, Japan

[21] Appl. No.: 196,643

[22] Filed: Feb. 15, 1994

[30] Foreign Application Priority Data

Feb. 16, 1993 [JP] Japan ..... 5-050035

[51] Int. Cl.[6] ..... C22C 2/02

[52] U.S. Cl. ..... 148/439; 420/534; 428/548

[58] Field of Search ..... 148/439; 420/534, 535; 428/548

[56] References Cited

FOREIGN PATENT DOCUMENTS 57-149445 9/1982 Japan ..... 420/534

60-197838 10/1985 Japan ..... 420/534

519486 4/1975 U.S.S.R. ..... 420/534

*Primary Examiner*—Melvyn J. Andrews

*Assistant Examiner*—Sikyin Ip

*Attorney, Agent, or Firm*—Flynn, Thiel, Boutell & Tanis

[57] ABSTRACT

The aluminum alloy of the invention has excellent fatigue strength, high rigidity, and low thermal expansion coefficient, and is suitable for rotating components such as conrods in an internal combustion engine. The aluminum alloy is an Al-Si alloy which contains 7.0–12.0% wt. Si, 3.0–6.0 % wt. Cu, 0.20–1.0% wt. Mg, 0.30–1.5% wt. Mn, 0.40–2.0% wt. Ti+V, 0.05–0.5% wt. Zr, and the remainder Al and being inevitable impurities and which contains a dispersed intermetallic compound of average particle size of 0.5 m or less and containing Ti, V, and Zr. The alloy is preferably manufactured by the rapidly solidifying powder metallurgy process, or by the spray-forming process. By selecting a work-hardening exponent of 0.20 or less, the thread rolling workability is improved.

13 Claims, 1 Drawing Sheet

HEAT-RESISTANT ALUMINUM ALLOY HAVING HIGH FATIGUE STRENGTH

FIELD OF THE INVENTION

This invention relates to a heat-resistant aluminum alloy having high fatigue strength and particularly to a heat-resistant aluminum alloy having high fatigue strength at a notched section, and which is suitable for moving components such as conrods (connecting rods) in an internal combustion engine and has workability for thread rolling.

BACKGROUND OF THE INVENTION

Recent concern about preservation of the global environment has highlighted the need for reducing the fuel consumption of motor vehicles. Since an effective means of reducing the fuel consumption is to decrease the weight of the vehicle itself, this has stimulated the development of light-weight materials. Decreasing the weight of moving components in internal combustion engines for motor vehicles to improve power output performance and save fuel is therefore a matter of importance. For example, conrods are subjected to high temperatures and high loads, and so require high thermal fatigue strength, rigidity, and low thermal expansion. To meet these requirements, various types of aluminum materials have been tested.

The rapid solidifying powder metallurgy process allows extension of alloying levels and the aluminum alloy formed by this process has significantly improved the fatigue strength, rigidity, and thermal expansion compared to materials formed by the conventional ingot metallurgy process. As a result, various types of rapidly solidified aluminum alloys have been developed for moving components such as conrods in internal combustion engines which have excellent heat resistance, creep resistance, and abrasion resistance.

Most of those rapidly solidified aluminum alloys contain approximately 5 to 30% Si and 1 to 15% Fe. Such alloys are disclosed, for example, in JP-A-2-61021 and JP-A-3-177530 (the prefix "JP-A-" referred to herein means "unexamined Japanese Patent publication"). These rapidly solidified aluminum alloys have excellent rigidity and fatigue strength compared with conventional aluminum alloys prepared by the ingot metallurgy process. However, this type of Al-Si—Fe alloy still has poor fatigue strength around notches such as the root of a thread. Consequently, as illustrated in FIG. 1, a conrod of the alloy is prone to fatigue cracks at the corner edge 6 of the face receiving the bolt head or at a notch such as the root of the thread of the threaded hole 5 tapped into the rod 2 to receive the bolt which secures the rod 2 to the head 3 at the big end of the conrod 1. This poor strength causes problems in the practical application of the material for moving components such as conrods in internal combustion engines.

SUMMARY OF THE INVENTION

An object of this invention is to provide a heat-resistant aluminum alloy having high fatigue strength.

Another object of this invention is to provide a heat-resistant aluminum alloy having high fatigue strength at notched sections (hereinafter referred to as "notch fatigue strength").

A further object of this invention is to provide a heat-resistant aluminum alloy having sufficient notch fatigue strength under operating conditions for moving components such as conrods in an internal combustion engine and having high rigidity and low thermal expansion.

These objects are achieved by an Al-Si aluminum alloy which contains 7.0–12.0% Si (hereinafter the symbol "%" designates percentage weight), 3.0–6.0% Cu, 0.20–1.0% Mg, 0.30–1.5% Mn, 0.05–0.5% Zr, 0.40–2.0% of either one or both of Ti and V, and the remainder Al and being inevitable impurities forming a dispersed intermetallic compound of average particle size 0.5 μm or less containing Ti, V, and Zr. The work-hardening exponent, N, of this aluminum alloy should preferably be 0.20 or less, and the alloy should be produced by extruding a rapid solidified billet formed by depositing the molten droplet sprayed using a non-oxidizing gas for rapid solidification and deposition.

According to this invention, the high rigidity and low thermal expansion of the heat-resistant aluminum alloy having high fatigue strength is due to the specific composition and texture of the alloy, and the fatigue strength at notches such as the root of a thread of a threaded hole is improved. In addition, the alloy can be thread-rolled by selecting a value of N at or below 0.20, which also improves the strength at notches. Consequently, the alloy is a suitable base material for moving components which require threading for connecting bolts such as conrods in an internal combustion engine.

DETAILED DESCRIPTION OF THE PREFERRED EMBODIMENTS

Figure 1:
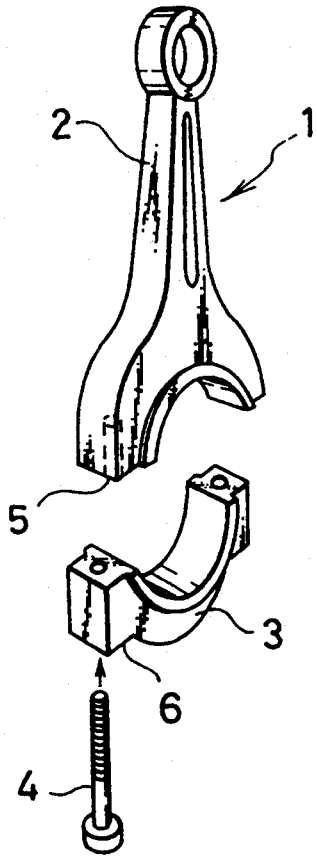
FIG. 1 is an oblique view of a conrod.

The reasons for adding the alloying elements in the specified quantities are described below.

Silicon is an essential element in the alloy of this invention and it disperses as Si particles. These particles of Si increase the notch fatigue strength, and give the alloy a high elastic modulus and low thermal expansion coefficient. However, Si particles are brittle by themselves and do not form a strong interface with the matrix. As a result, an excessively high Si content or coarse Si particles cause the Si particles to fracture and the interface to separate. This reduces the toughness and resistance to the initiation and propagation of fatigue cracks, thus reducing the notch fatigue strength. The Si content should be in the range of 7.0 to 12.0%. Below 7.0%, the addition of Si has little effect, while above 12.0% the Si particles do not microcrystallize so easily, and the notch fatigue does not increase. Excessive Si also increases the work-hardening exponent, N, thus reducing the workability of rolling, forging, and machining.

Copper coexists with Mg and forms a solid solution in the matrix to give the alloy age-hardening properties, thereby improving the high temperature strength and notch fatigue strength. The Cu content should be in the range of 3.0 to 6.0%. Below 3.0% the addition of Cu has little effect, while above 6.0% the effects saturate, the value of N increases and the ductility reduces, thus reducing the workability of rolling, forging, and machining. Magnesium coexists with Cu to give the material age-hardening properties, improving the high temperature strength and notch fatigue strength. The Mg content should be in the range 0.20 to 1.0%. Below 0.20% the addition of Mg has little effect, while above 1.0% the effects saturate.

Manganese forms a solid solution in the matrix, increasing the high temperature strength. The Mn content should be in the range 0.30 to 1.5%. Below 0.30% the addition of Mn has little effect, while above 1.5%, the insoluble Mn forms an Al-Cu-Mn compound, reducing the Cu concentration in the matrix and thus reducing the high temperature strength and notch fatigue strength.

Titanium and V form primary crystals of Al-Ti and Al-V compounds. Since these crystallized intermetallic compounds act as nuclei for solidification, the grain size upon solidification is fine. Furthermore, these finely dispersed compounds prevent possible recrystallization during the solid solution treatment of the alloy and gives the material a fibrous or finely recrystallized structure. In this manner, Ti and V also function as dispersion hardening. The effects of adding Ti and V improve the high temperature strength and notch fatigue strength, which are necessary for the material of conrods in an internal combustion engine. The Ti and V content should be in the range of 0.40 to 2.0% for the total of Ti and V. Below 0.40% the addition of Ti and V has little effect, while above 2.0% the effects saturate and coarse grains tend to form during solidification, thus reducing the workability of rolling, forging, and machining.

Zirconium forms primary crystals of an Al—Zr compound. Similar to Ti and V, the primary crystals form a fine grain structure on solidification and recrystallization. The crystallized compounds also act as particles for dispersion hardening. Zirconium also forms a solid solution in the matrix to a small amount, thus enhancing the formation of a GP zone and $\theta'$ intermediate phase in the Al-Cu-Mg system and improves the age-hardening properties. The Zr content should be in the range of 0.05 to 0.5%. Below 0.05% the addition of Zr has little effect, while above 0.5% the effects saturate and coarse particles tend to form during solidification, thus reducing the workability of rolling, forging, and machining.

With an alloy of this invention, finely dispersed intermetallic compounds such as a Al-Ti system, Al-V system, and Al-Zr system, which contain T, V, and Zr, improve the high temperature strength and the notch fatigue strength. In this invention, it is important that these intermetallic compounds are dispersed into the matrix at an average particle size of 0.5 μm or less. If the average particle size exceeds 0.5 μm, the grain growth at recrystallization is not suppressed so effectively, and the particles do not enhance dispersion hardening as well.

There are several methods of manufacturing the alloy of this invention. The preferred approach to produce an alloy with fine grains of the intermetallic compounds described above is the rapidly solidifying powder metallurgy process or the spray-forming process. The latter process was developed by Osprey Metals of the United Kingdom and disclosed in JP-A-62-1849, where the molten metals are rapidly solidified and deposited onto a collector to form the preliminary shape.

In this rapidly solidifying powder metallurgy process, atomizing, single rolling, or spray rolling is used to solidify the molten alloy at a cooling rate of 100K/sec or more. Optimization of the cooling rate yields a very fine intermetallic compound with a particle size of 0.5 μm or less. The spray-forming process uses a non-acidifying gas such as argon or nitrogen to atomize the alloy melt, which is then directly deposited onto a collector and immediately quenched to solidify at a cooling rate of $10^{2°}$ to $10^{4°}$ C./sec. to form a billet. Optimizing the temperature of the melt and the gas flow rate allows the intermetallic compound to crystallize with a particle size of 0.5 μm or less.

The rapid solidified powder or flake-like material is consolidated using a known method such as filling in a container—degassing—hot extrusion or filling in a container—degassing—hot press—hot extrusion followed by solution heat treatment, and aging. The spray-formed billet is then extruded directly at a high temperature followed by heat treatment. The crystallized intermetallic compound is made even finer by the hot extrusion, thus improving the strength and fatigue characteristics of the alloy.

Conventional aluminum alloys prepared by the rapidly solidifying powder metallurgy process for moving components of internal combustion engines, such as those developed for conrods, have poor workability. As a result, the bolt hole for the bolt connecting the rod with the head of the conrod has to be machined, which reduces the fatigue strength at notches such as the root of the thread. However, an alloy of this invention can be thread-rolled by selecting a work-hardening exponent, N, of 0.20 or less, and this increases the notch fatigue strength.

The work-hardening exponent, N, is given by the following equation:

$$N=\log(\sigma_1/\sigma_2)/\log(\epsilon_1/\epsilon_2)$$

where, $\sigma_1$ is the true stress giving 0.2% proof stress $\epsilon_1$ is the true strain at $\sigma_1$ $\sigma_2$ is the true stress at fracture $\epsilon_2$ is the true strain at $\sigma_2$ as defined on the true stress-strain diagram.

This equation shows that, for two alloys which have the same proof stress and tensile strength, the alloy having the higher true strain has a lower value of N. In other words, an alloy with a low value of N allows greater elongation and gives better rolling workability. In the case of thread rolling for the same diameter of hole or for the same strain, a larger value of N gives a larger difference between $\sigma_1$ and $\sigma_2$, which means that the resistance to deformation gradually increases during rolling, reducing the workability and the life of the rolling tool. The main reason for restricting the value of N at or below 0.20 in this invention is that this leaves a large residual compressive stress on the threading hole during rolling. This residual compressive stress on the threaded part improves the fatigue strength at notches, such as the root of the thread, and also increases the reliability and strength of the threaded part. When the value of N exceeds 0.20, satisfactory rolling is not possible because the strain, or the elongation, becomes less than the level of proof stress and tensile strength, and the residual stress also reduces. The optimum value of N is 0.12 or less to allow the machining line to be operated at a speed with an acceptable frequency of tool replacement.

EMBODIMENT

This invention is described in more detail with comparison to reference examples. In the embodiment, the rapidly solidifying powder metallurgy process and the spray-forming process are used to precisely obtain fine intermetallic compounds.

Example 1

The Al—Si alloys No. 1 through No. 12 shown in Table 1 were melted and spray-formed, sprayed with nitrogen gas in a nitrogen gas atmosphere and deposited onto a cylindrical collector. The cylindrical billet so formed was approximately 260 mm in diameter and 600 mm in length. Each billet was extruded at 450° C. to form a rod of 50 mm in diameter. The rod was then subjected to T-6 treatment: the rod was solution treated (500° C. for 1 hr), water-cooled, then age-hardened at a high temperature (180° C. for 5 hrs followed by air cooling). The average size of the intermetallic compounds, thermal expansion coefficient (linear expansion coefficient from room temperature to 200° C.), value of N at room temperature, and tensile properties at 150° C. were then measured for the T-6 material. The results are summarized in Table 2.

Figure 2:
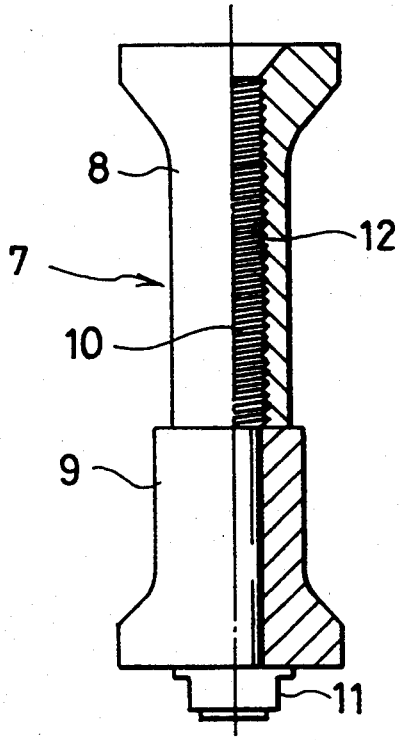
FIG. 2 is a specimen of a notch fatigue test corresponding to the bolt section of the big end of a conrod.

As shown in FIG. 2, a test piece 7 was prepared from each alloy rod corresponded to the bolt section of the big end of a conrod. The test piece was subjected to loading at 150° C., a stress ratio R of 0.1, and a cyclic loading frequency of 30 Hz to determine the fatigue strength after $10^6$ cycles (represent to the maximum stress of cyclical stress, determined by dividing the load applied to the test piece by the cross-sectional area, using the effective thread diameter for the threaded part). The results are summarized in Table 2. The test piece 7 was assembled by connecting the rod 8 and the head 9 with a steel bolt 10 and a nut 11. The threaded hole 12 in the rod section 8 was formed by thread rolling. The diameter of the hole was selected to give a thread engagement of 70% or more to prevent the threaded face from sinking. The value of N of the alloy must be kept at 0.20 or less to withstand such severe conditions.

Example 2

Alloys No. 13 and 14 shown in Table 1 were melted and atomized to prepare rapidly solidified powder. The powder was sieved to mesh size 300 μm or less. The sieved powder was packed in an aluminum can, vacuum degassed at 500° C. for 1 hr, then extruded at 450° C. to form a rod 50 mm in diameter. The rod was subjected to T-6 treatment under the same conditions as Example 1 and was then analyzed to determine the average size of the intermetallic compound, thermal expansion coefficient, value of N at room temperature, tensile properties at 150° C., and notch fatigue strength at 150° C., using a procedure similar to Example 1. Two kinds of notch fatigue test pieces were prepared: One was formed by rolling the threaded hole 12 in the rod 8, and the other was formed by machining the threaded hole. The threaded hole formed by machining was made to have the same shape and dimensions as the hole formed by rolling. The results are summarized in Table 2.

TABLE 1

| | Composition (% weight) | | | | | | | |
|---|---|---|---|---|---|---|---|---|
| No | Si | Cu | Mn | Mg | Ti | V | Zr | Al |
| 1 | 9.5 | 4.0 | 0.7 | 0.32 | 1.0 | — | 0.20 | Remainder |
| 2 | 9.5 | 4.0 | 0.7 | 0.9 | 0.5 | 0.5 | 0.20 | Remainder |
| 3 | 9.6 | 4.0 | 0.33 | 0.45 | 1.0 | — | 0.20 | Remainder |
| 4 | 9.5 | 4.0 | 1.4 | 0.45 | 1.0 | — | 0.20 | Remainder |
| 5 | 9.5 | 4.0 | 0.7 | 0.45 | 1.0 | — | 0.07 | Remainder |
| 6 | 9.5 | 4.0 | 0.7 | 0.45 | 1.0 | — | 0.45 | Remainder |
| 7 | 9.5 | 4.0 | 0.7 | 0.45 | — | 0.45 | 0.20 | Remainder |
| 8 | 9.5 | 4.0 | 0.7 | 0.45 | 1.0 | 0.7 | 0.20 | Remainder |
| 9 | 7.3 | 4.0 | 0.7 | 0.45 | 1.0 | — | 0.20 | Remainder |
| 10 | 11.5 | 4.0 | 0.7 | 0.45 | 1.0 | — | 0.20 | Remainder |
| 11 | 9.5 | 3.3 | 0.7 | 0.45 | 0.5 | 0.5 | 0.20 | Remainder |
| 12 | 9.5 | 5.7 | 0.7 | 0.45 | 1.0 | — | 0.20 | Remainder |
| 13 | 9.5 | 4.0 | 0.7 | 0.9 | 0.5 | 0.5 | 0.20 | Remainder |
| 14 | 9.5 | 3.3 | 0.7 | 0.45 | 0.5 | 0.5 | 0.20 | Remainder |

TABLE 2

| No | Average particle size of intermetallic compound (μm) | Linear expansion coefficient ($\times 10^6$/K) | Value of N | Tensile properties (at 150° C.) Tensile strength (MPa) | Elongation (%) | Notch fatigue strength (at 150° C.) |
|---|---|---|---|---|---|---|
| 1 | 0.17 | 19.8 | 0.08 | 400 | 15 | 150 |
| 2 | 0.14 | 20.1 | 0.10 | 410 | 12 | 165 |
| 3 | 0.20 | 20.0 | 0.09 | 392 | 13 | 145 |
| 4 | 0.12 | 19.7 | 0.09 | 416 | 12 | 165 |
| 5 | 0.11 | 20.0 | 0.08 | 385 | 15 | 150 |
| 6 | 0.13 | 19.9 | 0.09 | 414 | 11 | 165 |
| 7 | 0.10 | 20.2 | 0.09 | 380 | 15 | 150 |
| 8 | 0.23 | 19.7 | 0.14 | 421 | 10 | 170 |
| 9 | 0.16 | 20.6 | 0.12 | 395 | 17 | 150 |
| 10 | 0.15 | 19.5 | 0.13 | 406 | 11 | 160 |
| 11 | 0.17 | 20.2 | 0.09 | 393 | 13 | 160 |
| 12 | 0.21 | 19.9 | 0.09 | 410 | 13 | 170 |
| 13 | 0.09 | 20.0 | 0.10 | 414 | 13 | 155(Rolling) |
| 13 | 0.09 | 20.0 | 0.10 | 414 | 13 | 143(Machining) |
| 14 | 0.10 | 20.1 | 0.09 | 401 | 14 | 140(Rolling) |
| 14 | 0.10 | 20.1 | 0.09 | 401 | 14 | 131(Machining) |

As shown in Table 2, the alloys produced in Example 1 and Example 2 had a low thermal expansion coefficient, and had excellent tensile properties and notch fatigue strength at high temperature.

Comparison Example 1

Al—Si alloys No. 1 to 11 listed in Table 3 were melted and separately spray-formed to prepare cylindrical billets having the same dimensions as in Example 1. Each of the billets was extruded and T-6 treatment was applied under the same conditions as Example 1. The same properties as in Example 1 were then measured for the T-6 treated rods; the results are summarized in Table 4. The notch fatigue test pieces were prepared by applying the thread rolling process to the rod, similar to Example 1, and only the test pieces which could not be thread-rolled were machined for threading.

Comparison Example 2

Alloy No. 12 shown in Table 3 was melted to form a billet of diameter 260 mm and length 600 mm by permanent mold casting. The billet was then soaked at 490° C. for 5 hrs followed by air cooling, then extruded at 450°

C. to obtain a rod of 50 mm diameter. The rod was then T-6 treated as in Example 1 and its properties were analyzed; the results are summarized in Table 4. The threaded hole of the fatigue test piece was formed by thread rolling.

TABLE 3

| No | Composition (% weight) | | | | | | | | | |
|---|---|---|---|---|---|---|---|---|---|---|
| | Si | Cu | Mn | Mg | Ti | V | Zr | Fe | Ni | Al |
| 1 | 6.0 | 4.0 | 0.7 | 0.45 | 1.0 | — | 0.20 | — | — | Remainder |
| 2 | 12.5 | 4.0 | 0.7 | 0.45 | 1.0 | — | 0.20 | — | — | Remainder |
| 3 | 9.5 | 2.5 | 0.7 | 0.45 | 1.0 | — | 0.20 | — | — | Remainder |
| 4 | 9.5 | 7.0 | 0.7 | 0.45 | 1.0 | — | 0.20 | — | — | Remainder |
| 5 | 9.5 | 4.0 | — | 0.45 | 1.0 | — | 0.20 | — | — | Remainder |
| 6 | 9.5 | 4.0 | 0.7 | 0.10 | 1.0 | — | 0.20 | — | — | Remainder |
| 7 | 9.5 | 4.0 | 0.7 | 0.45 | 1.0 | — | — | — | — | Remainder |
| 8 | 9.5 | 4.0 | 0.7 | 0.45 | — | 0.20 | 0.20 | — | — | Remainder |
| 9 | 9.5 | 4.0 | 0.7 | 0.45 | 1.5 | 1.5 | 0.20 | — | — | Remainder |
| 10 | 9.5 | 4.0 | 0.7 | 0.45 | 1.0 | — | 0.20 | 1.0 | — | Remainder |
| 11 | 9.5 | 4.0 | 0.7 | 0.45 | 1.0 | — | 0.20 | — | 1.5 | Remainder |
| 12 | 9.5 | 4.0 | 0.7 | 0.9 | 0.5 | 0.5 | 0.20 | — | — | Remainder |

TABLE 4

| No | Average particles size of intermetallic compound (μm) | Linear expansion coefficient ($\times 10^6$/K) | Value of N | Tensile properties (at 150° C.) Tensile strength (MPa) | Elongation (%) | Notch fatigue strength (150° C.) (MPa) |
|---|---|---|---|---|---|---|
| 1 | 0.18 | 21.2 | 0.09 | 395 | 18 | 130 |
| 2 | 0.19 | 19.3 | 0.25 | 407 | 7 | Cannot be rolled |
| 2 | 0.19 | 19.3 | 0.25 | 407 | 7 | 100(Machining) |
| 3 | 0.16 | 20.4 | 0.10 | 367 | 14 | 110 |
| 4 | 0.14 | 19.5 | 0.23 | 431 | 11 | Cannot be rolled |
| 4 | 0.14 | 19.5 | 0.23 | 431 | 11 | 110(Machining) |
| 5 | 0.16 | 20.1 | 0.09 | 362 | 10 | 120 |
| 6 | 0.17 | 20.0 | 0.10 | 370 | 16 | 125 |
| 7 | 0.15 | 20.0 | 0.09 | 364 | 17 | 125 |
| 8 | 0.11 | 20.2 | 0.10 | 354 | 18 | 120 |
| 9 | 0.27 | 19.6 | 0.25 | 436 | 7 | Cannot be rolled |
| 9 | 0.27 | 19.6 | 0.25 | 436 | 7 | 105(Machining) |
| 10 | 0.20 | 19.7 | 0.09 | 370 | 10 | 120 |
| 11 | 0.17 | 19.6 | 0.09 | 366 | 10 | 110 |
| 12 | 4.1 | 20.1 | 0.14 | 357 | 6 | 90 |

Table 4 shows that the comparison alloy No. 1 contained less Si which gives a high thermal expansion coefficient and insufficient fatigue strength. Comparison alloy No. 2 contained more Si than specified in this invention, which resulted in a high value of N and inhibited thread rolling. In addition, a test piece of comparison alloy No. 2 threaded by machining had an insufficient notch fatigue strength. Comparison alloy No. 3 contained a large amount of Cu and hence both the tensile strength and the fatigue strength were poor. Comparison alloy No. 4 also contained a large amount of Cu, so the value of N was high, which inhibited thread rolling; a test piece of comparison alloy No. 4 which was machined for threading showed an insufficient notch fatigue strength.

Comparison alloy No. 5 did not contain Mn which is an essential element of this invention, and thus yielded poor high temperature strength and fatigue strength. Comparison alloy No. 6 contained little Mg, comparison alloy No. 7 did not contain Zr, and comparison alloy No. 8 contained little Ti+V, thus all had inferior tensile and fatigue strengths, as for alloy No. 5.

Comparison alloy No. 9 contained more Ti+V than the upper limit of 2.0% of this invention, thus the value of N increased while rolling workability decreased, and thread rolling was not possible. A test piece of alloy No. 9 which was threaded by machining showed insufficient notch fatigue strength. Comparison alloys No. 10 and 11 contained Fe and Ni, respectively, and these elements formed their corresponding compound of Cu, reducing the Cu content of the matrix, which in turn weakened the effect of adding Cu and reduced the tensile and fatigue strength. Comparison alloy No. 12 was prepared by conventional processes including permanent mold casting, soaking, hot extrusion, and T-6 treatment, and this resulted in the growth of particles of the intermetallic compounds again degrading the tensile strength and the fatigue strength.

As described above, this invention provides a heat-resistant aluminum alloy having high notch fatigue strength, high rigidity, and low thermal expansion, and the alloy of this invention improves the strength of notched sections. Therefore, it should be possible to effectively use the alloy of this invention as a material for moving components such as conrods in an internal combustion engine.

What is claimed is:

1. A heat-resistant aluminum alloy having a high fatigue strength and consisting essentially of 7.0–12.0 wt. % Si, 3.0–6.0 wt. % Cu, 0.20–1.0 wt. % Mg, 0.30–1.5 wt. % Mn, 0.05–0.5 wt. % Zr, 0.40–2.0 wt. % of at least one member selected from the group consisting of Ti and V, and the balance being Al and inevitable impurities, said alloy containing dispersed intermetallic compounds having an average particle size of up to 0.5 μm and Zr and at least one of Ti and V and being worked into a required shape from an ingot or a billet formed by consolidating a rapidly solidified atomized powder.

2. A heat-resistant aluminum alloy having a high fatigue strength and consisting essentially of 7.0–12.0 wt. % Si, 3.0–6.0 wt. % Cu, 0.20–1.0 wt. % Mg, 0.30–1.5 wt. % Mn, 0.05–0.5 wt. % Zr, 0.40–2.0 wt. % of at least one member selected from the group consisting of Ti and V, and the balance being Al and inevitable impurities, said alloy containing dispersed intermetallic compounds having an average particle size of up to 0.5 μm and Zr and at least one of Ti and V and being worked into a required shape from an ingot or a billet formed by depositing a molten alloy droplet formed by atomizing a molten alloy using a non-oxidizing gas.

3. The alloy of claim 1, wherein said alloy contains 3.0–5.0 wt. % Cu, 0.35–0.55 wt. % Mg, 0.6–0.8 wt. % Mn and 0.1–0.3 wt. % Zr.

4. The alloy of claim 2, wherein said alloy contains 3.0–5.0 wt. % Cu, 0.35–0.55 wt. % Mg, 0.6–0.8 wt. % Mn and 0.1–0.3 wt. % Zr.

5. The alloy of claim 1, wherein said alloy has a work-hardening exponent N of up to 0.20.

6. The alloy of claim 2, wherein said alloy has a work-hardening exponent N of up to 0.20.

7. The alloy of claim 1, wherein said alloy has a work-hardening exponent N of up to 0.15.

8. The alloy of claim 2, wherein said alloy has a work-hardening exponent N of up to 0.15.

9. The alloy of claim 1, wherein the alloy is formed in the shape of a billet by consolidating a rapidly solidified atomized powder and extruding the consolidated rapidly solidified atomized powder into a required shape.

10. The alloy of claim 2, wherein the alloy is formed in the shape of a billet by depositing a molten alloy droplet formed by atomizing a molten alloy using a non-oxidizing gas and is extruded into a required shape.

11. The alloy of claim 10, wherein the non-oxidizing gas is nitrogen.

12. The alloy of claim 1, wherein at least 0.40 wt. % of V present.

13. The alloy of claim 2, wherein at least 0.40 wt. % of V is present.

* * * * *